United States Patent [19]

Wölfges

[11] Patent Number: 4,555,976

[45] Date of Patent: Dec. 3, 1985

[54] DEVICE FOR CONTROLLING A HYDROMOTOR

[75] Inventor: Hans Wölfges, Lohr, Fed. Rep. of Germany

[73] Assignee: Mannesmann Rexroth GmbH, Lohr, Fed. Rep. of Germany

[21] Appl. No.: 459,624

[22] Filed: Jan. 20, 1983

[30] Foreign Application Priority Data

Jan. 20, 1982 [DE] Fed. Rep. of Germany ..... 3201546

[51] Int. Cl.[4] ..... F15B 11/05

[52] U.S. Cl. ..... 91/420; 91/447

[58] Field of Search ..... 91/420, 447; 137/596.2

[56] References Cited

FOREIGN PATENT DOCUMENTS 2021857 12/1977 Fed. Rep. of Germany ..... 91/420
2911891 10/1980 Fed. Rep. of Germany .
1593901 7/1981 United Kingdom .

OTHER PUBLICATIONS

K. Kasperbauer, *Stromventile,* 1972, pp. 97–103.
"Fluid", Feb. 1979, pp. 31–33.

*Primary Examiner*—Gerald A. Michalsky
*Attorney, Agent, or Firm*—Michael J. Striker

[57] ABSTRACT

A device for controlling a consumer, in particular a hydromotor includes a restrictor, preferably an electro-hydraulic proportional directional control valve, and a control valve operating on the basis of a releasable non-return valve. The control valve is provided with an actuating cylinder-and-piston unit having control ports and a biasing spring for the piston. The control valve also has a connecting port which is connected with a connecting port of the restrictor. In order to substantially simplify the structural design of the device, a flow regulator is installed between the control port of the control valve and the connecting port of the restrictor which is connected with the consumer. The control sides of the flow regulator and the control valve are connected through a throttle with a supply container. The space of the cylinder-and-piston unit adjoining the control side of the control piston is connected with another connecting port of the control valve and with the restrictor.

8 Claims, 4 Drawing Figures

DEVICE FOR CONTROLLING A HYDROMOTOR

BACKGROUND OF THE INVENTION

The present invention relates to a control device for a hydromotor and in particular to a control device of the type having flow restricting means including a proportional directional control valve and a flow control valve with a releasable non-return valve actuated by a spring-loaded cylinder-and-piston unit.

A known control valve which is designed as a speed lowering brake valve is controlled immediately by the pump pressure which is present between the pump and the hydromotor. During fluctuating pump pressure the control piston of the brake valve, which is admitted in accordance with the fluctuations, causes the valve member of the brake valve to be controlled accordingly. Thereby, different pressures are generated between the connection connected with the brake valve and the connection of the directional control valve which is connected with the supply container, whereby at otherwise the same position of the valve member of the directional control valve, different streams of pressure medium flow from the hydromotor to the supply container (the German periodical "Fluid", February, 1979, pages 31–33).

In order to control the hydromotor independently of its load, it is also known to switch a pressure regulator valve between the control side of the brake valve and the hydromotor whose reduced constant pressure acts on the control piston of the brake valve. Thereby, the pressure at the connection point of the brake valve with the proportional directional control valve is kept constant, whereby irrespective of the pressure loss in the lines, the differential pressure between the connections of the directional control valve to the brake valve and to the supply container, is kept constant. Therefore, pressure fluctuations on the pump side or consumer side do not have any effect on the quantity of the return flow. The brake valve acts as a pressure compensator whereby its braking function is not impaired. The use of a pressure control valve is relatively expensive (DE-OS No. 29 11 891).

SUMMARY OF THE INVENTION

It is an object of the present invention to substantially simplify the structural design of the aforementioned device. This object is obtained in accordance with the invention by the provision of a flow control circuit including a flow regulating member connected between one control port of the cylinder-and-piston unit of the flow control valve and the outlet port of the restricting directional control valve leading to the consumer; a throttle connecting the one control port of the cylinder-and-piston unit with the supply container; and a conduit connecting the flow control valve with the other control port at an opposite side of the actuation piston of the cylinder-and-piston unit.

Preferably, the proportional control valve has two pairs of inlet and outlet ports each connected to the consumer via symmetrically arranged flow control valves with associated actuating cylinder-and-piston units each provided with the above described flow control circuit of this invention. The inventive structural design is substantially simpler than the known device which is provided with a pressure control valve, and can therefore be made more economical.

In a further elaboration of this invention, the control piston acts as an adjustment piston for the pressure compensator for opening the valve member, for controlling the flow of the pressure medium for the control of the adjacent control piston, and also as a non-return valve.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
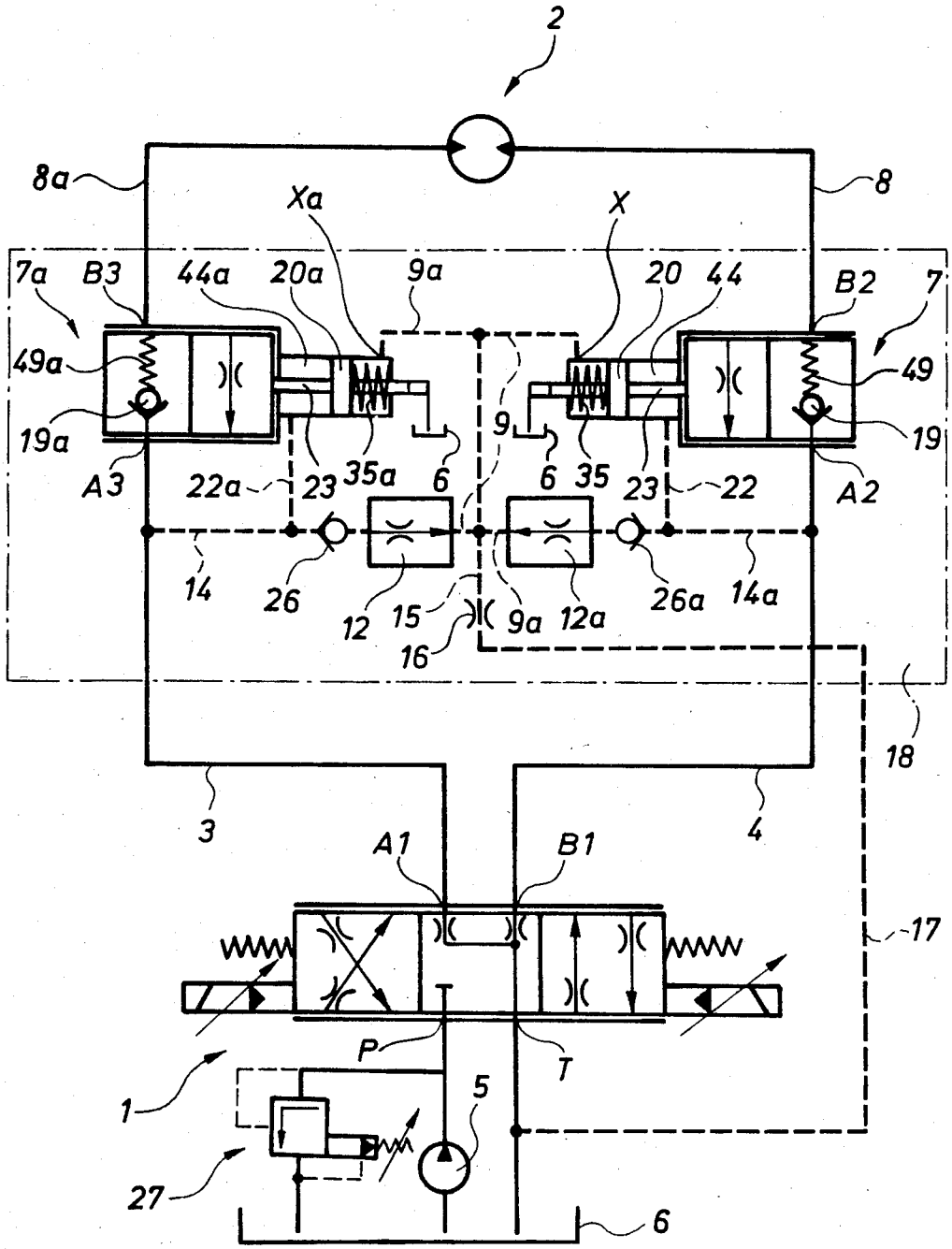
FIG. 1 is a block diagram of the control device of this invention.

A directional control valve 1 is designed as an electrohydraulic proportional valve and defines, depending on the controllable magnetic current, the throttle face or restricting surface delimited by the control piston and thereby the throughflow quantity of the pressure medium. The directional control valve 1 has a connection A1 which is connected through a line 3 with a connection A3 of a control valve **7*a* in the form of a releasable non-return valve. The connection B3 of the control valve 7*a* is connected through a line 8*a* with a consumer, for example, a double acting hydromotor 2. A connection B1 of directional control valve 1 is connected through a line 4 with a connection A2 of a control valve 7 also in the form of a releasable non-return valve. The connection B2 of the control valve is connected through a line 8 with the hydromotor 2. A connection P on the directional control valve 1 is connected with a pump 5 and another connection T is connected with a supply container 6**.

The control valve 7 has a control connection X which is connected through a control line 9 with one side of a flow regulator 12 controlling in the direction to the control connection X. The other side of the regulator is connected through a control line 14 with line 3. A control line 15 in which an adjustable nozzle 16 is provided, is connected to the control line 9 and through a control line 17 with the supply container 6. Nozzle 16 may be replaced by a pressure relief valve which also acts as a throttle.

The control valve 7 has a main valve member 19 and a control piston 20 actuating the same, whereby the same cross sections of the control piston are acted upon through the connections X and A2 leading to control lines 9 or 22 on opposite sides of the piston. A control spring 35 is braced between the control piston 20 and a stationary cylindrical part of the housing of control valve 7 at the side of connection X. The control piston 20 has a piston rod 23 which is guided on the side facing the main valve member 19.

A control line **14*a* connects control line 9 to line 4. A non-return valve 26*a* is provided between the connection point of control lines 22 and 14*a* and another flow regulator 12*a* corresponding to the flow regulator 12. A non-return valve 26 which opens to the flow regulator 12 is provided in line 14 after the connection point of the control line 14 and 22***a*. Line 22*a* is connected with the chamber 44*a* of cylinder-and-piston unit pertaining to valve 7*a*.

The control valve 7*a* with regulator 12*a* and the non-return valve 26*a* is structurally the same as the control valve 7 with regulator 12 and non-return valve 26. The lines are indicated with the same numerical references, whereby the reference numerals of the control lines or valves which are associated with the control valve 7*a* are provided with the additional letter "a".

The control ports X and Xa of control valves 7 or 7*a* and the control ports of regulators 12 and 12*a* are connected with each other and with the nozzle 16 by means of control lines 9, 9*a* and 15 in the manner shown in the drawings.

Assuming that the proportional directional control valve 1 is in a position in which the port P is connected to port A1 and port B1 to port T, then the pressure adjusted on the pressure relief valve 27 is reduced by the throughput resistance through line 3 and the main valve member 19*a* of control valve 7*a* which acts as the non-return valve and further through line 8*a* is applied to a connection on hydromotor 2. On the spring side of the main valve member 19 of the control valve 7, the pump pressure present in the connection B2 of line 8 is either reduced or increased due to the pressure generated by the load of the hydromotor 2, depending on the action direction. The flow regulator 12 permits a constant flow of pressure medium in the direction to the control line 9, independent from the pressure in line 3. This constant flow of pressure medium generates on throttle or nozzle 16 a uniform impact pressure which acts through the control connection X on control piston 20. Thereby, the pressure of connection A2 of the control valve 7 remains constant. This pressure corresponds to the pressure in control connection X in addition to the pressure generated by the force of control spring 35 and less the pressure generated by pressure spring 49.

The pressure differential between the connections B1 and T of the proportional directional control valve 1 is kept constant with the assistance of the control valve 7, so that a uniform quantity flows through the proportional directional control valve 1, independent from the pressure in line 8. The superfluous pressure between the connections B2 and A2 is removed by the main valve member 19.

The other control valve 7*a* has the same effect as the control valve 7. When the proportional directional control valve 1 is switched in the median position as shown in the drawing, the connections A1 and B1 are immediately connected with the supply container 6 and the control connections X and Xa through the nozzle 16 with the supply container. The pressure in these connections corresponds to the pressure in the supply container and the pressure springs 49 and 49*a* of control valves 7 and 7*a* close the main valve members 19 and 19*a* free from pressure medium against the pressure generated by the load in hydromotor 2. As will be explained later, in the other two switch positions of the proportional directional control valve 1, the main valve members 19 and 19*a* also close free of pressure medium the pressure generated by the load even in the case when the pump pressure due to pipe breakage or power failure collapses to the pressure in supply container 6. The advantage of the control valves 7 and 7*a* connected in the aforedescribed manner is in the fact that they act as pressure compensator for pressures generated by loads, independent from the direction of the given load. Thereby, an advancing of this load is effectively eliminated. In addition, the main valve members 19 and 19*a* and their pre-control members 51 or 51*a* (FIG. 2) which are designed as seat elements permit a pressure medium free closing off during failing pump pressure and thereby prevent a lowering of the load.

For example, if the hydromotor 2 is designed as a differential cylinder with a face ratio of 1:2 and if the outer load acts on the annular face of the piston adjoining the piston rod, a pressure would be active during a discharge control in this cylinder space which would amount to a sum of the twofold pump pressure and the pressure generated by the load. For eliminating such a high cylinder load the throttling surfaces of the control piston of the proportional directional control valve 1 in the passages from ports A1 and B1 to the port T are designed larger with respect to the throttling surfaces in the passages from port P to ports A1 or B1. Thereby, the load independent discharge control during a negative load could be changed in a supply control and the pressure on the piston rod side of the differential cylinder is substantially limited to the pressure generated by the load. Thereby, the control valve 7 assumes the function of a braking valve. As described in the following, the use of two releasable control valves 7 and 7*a* results in a simplification in the structural design since the flow regulator 12 of control valve 7*a* supplies the constant flow of pressure medium for generating the constant impact pressure on the nozzle 16 for the control connection X of the control valve 7. The same is true in a reversed manner for the flow regulator 12*a*.

Figure 2A:
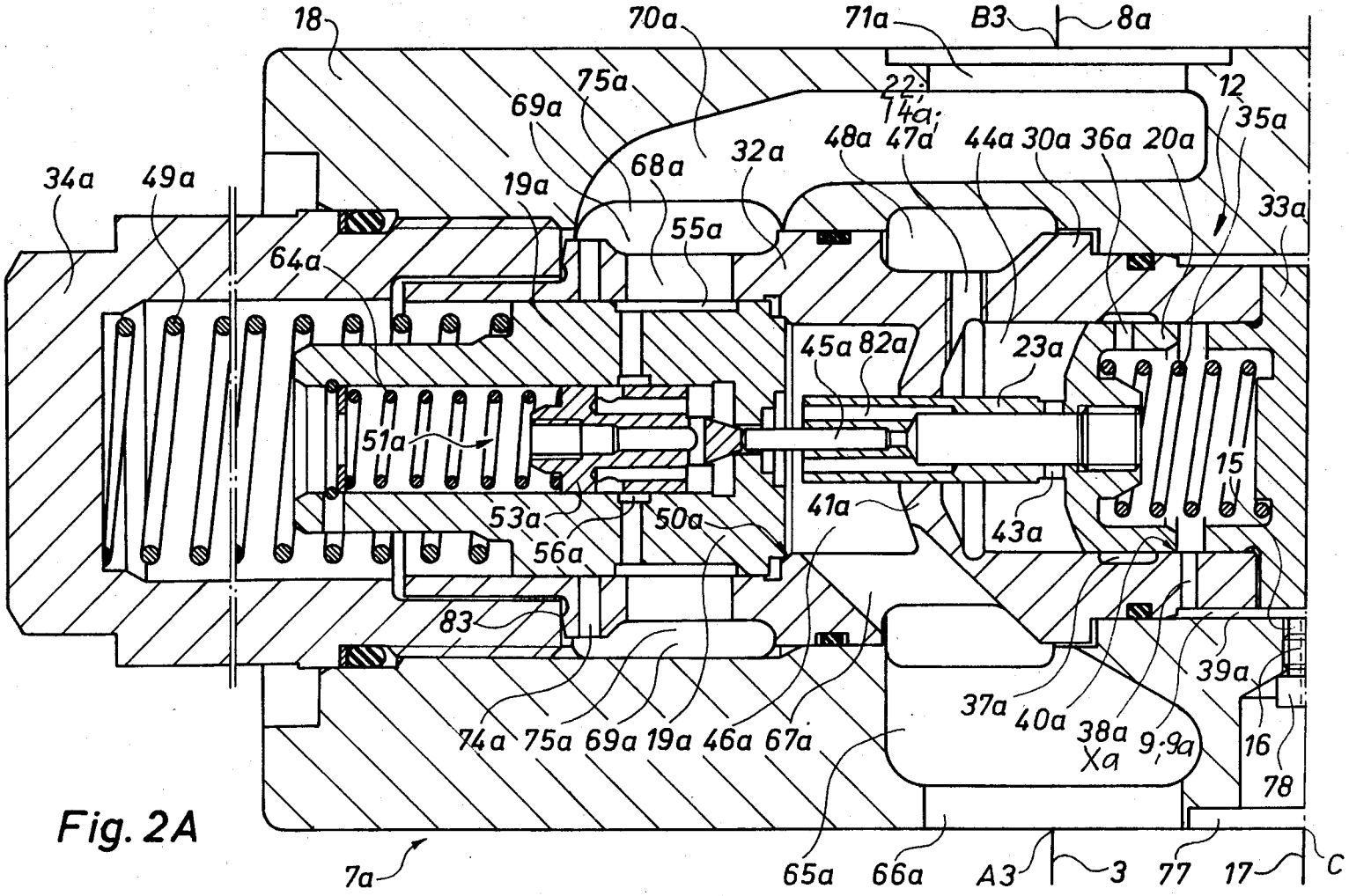
FIGS. 2A and 2B are longitudinal sections through a double valve in the device of this invention.
Figure 2B:
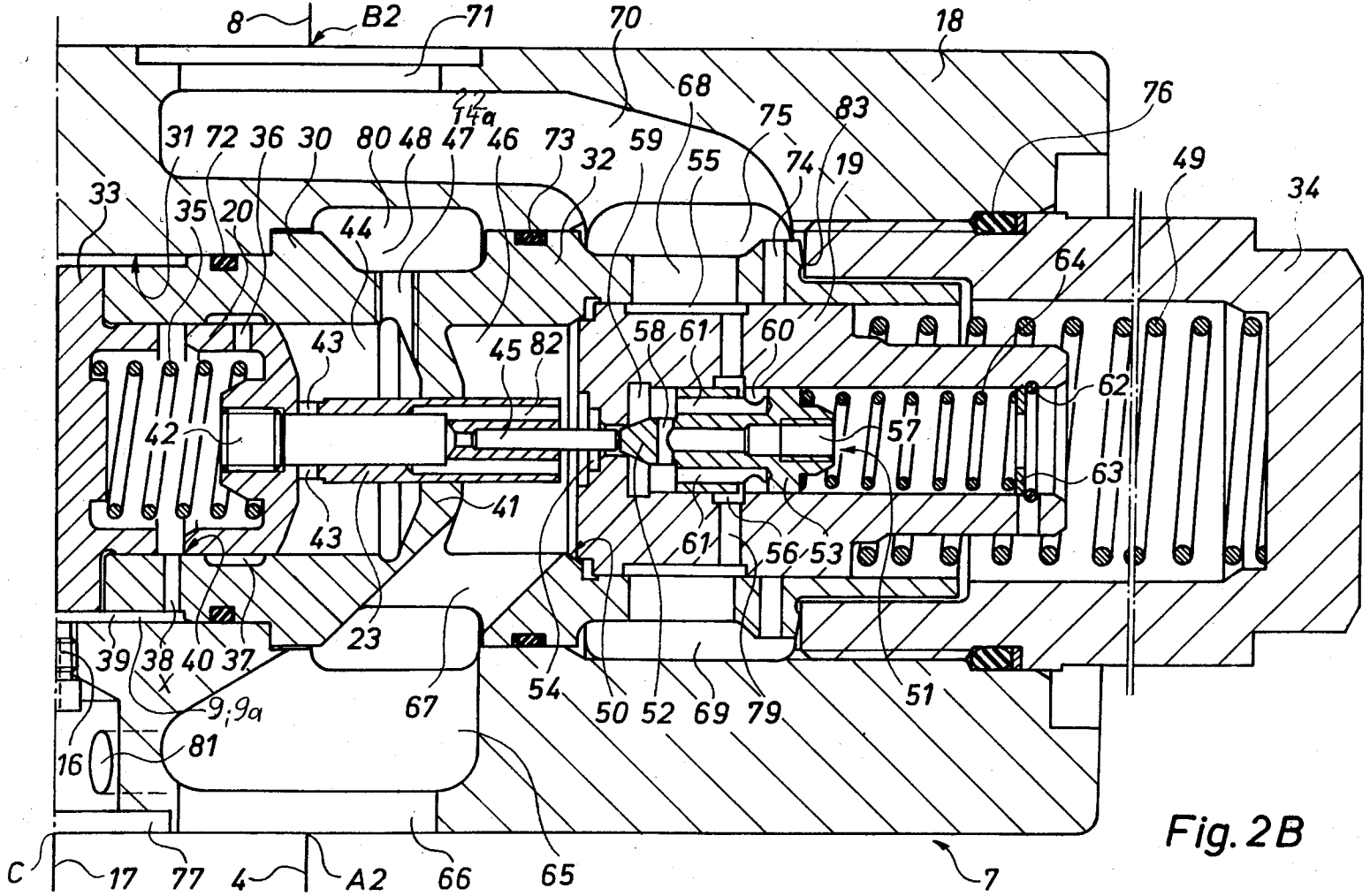

In the structural design of the double valve 7*a* and 7 shown in FIGS. 2A and 2B, a housing 18 has a center bore 31 into which bushings 32 and 32*a* are inserted from the two end sides thereof. On the opposite faces the bushings are provided with end pieces 33 and 33*a*. The two end pieces 33, 33*a* engage with each other and are disposed in the center of the center bore 31. The bushings 32, 32*a* are retained by means of a jacket-like hollow screws 34 and 34*a* respectively which is screwed into the housing. The hollow screw 34 engages the bushing 32 and urges its shoulder 30 onto a counter shoulder in housing 18, whereas a corresponding shoulder 30*a* of bushing 32*a* is spaced apart a small distance from the associated counter shoulder in housing 18.

In the range of its end piece 33, the bushing 32 receives the control piston 20. A control spring 35 is braced between the end piece 33 and the control piston 20. The control piston 20 is designed like a sleeve and supports in its jacket a calibrated nozzle 36 which extends therethrough. In the position of the control piston 20 shown in the drawing, an annular groove 37 is provided in bushing 32 in the area of the calibrated nozzle 36. A radially extending control bore 38 is provided in bushing 32 between the annular groove 37 and the end piece 33 which opens into an annular groove 39 provided on the outer side of bushing 32. In the position of the control piston 20 shown in the drawing, the control bore 38 is open. The edge of the control piston 20 adjacent to this control bore 38 acts as a control edge 40.

A locking screw 42 is screwed into the hollow piston rod 23 of the control piston 20. Furthermore, radial bores 43 are provided in the area of the control piston 20 which connect the inner space of piston rod 23 with the chamber 44 encompassing the piston rod. The piston rod 23 supports at its end removed from control piston 20 an axially protruding pin 45, parallel to which bores 82 are provided with respect to the front side of the piston rod 23. The piston rod 23 is guided in a transverse wall 41 of bushing 32 which separates the chamber 44 from the chamber 46. The chamber 44 is connected with an annular groove 48 on the outer circumference of bushing 32 by means of a radial bore 47 provided in bushing 32. A throttle screw with a throttle location can be screwed into the radial bore 47.

The sleeve-like main valve member 19 is displaceably mounted in the bushing 32 away from the end piece 33. A valve spring 49 braced between the bottom of the hollow screw 34 and the main valve member 19 holds the main valve member 19 on a frustoconical valve seat 50 of bushing 32. A pre-control member 51 is axially and displaceably mounted in the main valve member 19 which is provided with a frustoconical valve seat 52 and a slide-like valve part 53. The frustoconical valve part 52 controls a stepped valve bore 54 provided on the bottom of the main valve member 19 and the valve part 53 controls radial transverse bores 79 in the jacket of the main valve member 19 which discharge in annular grooves 55 and 56 on the outside and the inside of the main valve member 19.

The pre-control member 51 has a center bore 57 which extends to the valve part 52, whereby a throttle screw can be screwed into the center bore with a throttle location on the side facing away from the valve part 52. The center bore 57 is connected through a transverse bore 58 with a chamber 59 which is limited from the bottom of the main valve member 19 and the valve part 52 as well as the side of the pre-control member 51 facing the valve part 52. The valve part 53 has an annular groove 60 which, in the shown closed position of the pre-control member 51, is disposed on the side of the annular groove 56 facing away from the valve part 52. The annular groove 60 is connected with bores 61 which are present in the pre-control member 51 disposed parallel to center bore 57 which discharge into chamber 59. A pre-control spring 64 is braced between the pre-control member 51 and a perforated disk 63 retained by a clamp ring 62. The bias of this spring is so large that the pre-control valve 52, **52*a* maintains its closed position when the main valve member 19, 19*a*** operates like a non-return valve.

An annular groove 80 is disposed opposite annular groove 48 in housing 18 which is connected through a hollow chamber 65 and a bore 66 with the connection location A2. The chamber 46 is connected with the annular groove 48 by means of an oblique bore 67. Radial bores 68 are provided in the area of the annular groove 55 disposed in the main valve member 19 which discharge in an annular groove 69 in housing 18 in the shown position of the main valve 19. The annular groove 69 is connected through a hollow chamber 70 and a bore 71 with the connecting location B2.

A packing ring 72 is disposed in an annular groove in the area of annular groove 37 on the outside of bushing 32. A second packing ring 73 is disposed between the annular groove 48 and the radial bores 68. The packing rings 72 and 73 seal the slot between the bushing 32 and housing 18. Adjacent the radial bores 68, on the side facing away from the end piece 33, radial bores 74 with a smaller diameter are provided which do not open into the annular groove 75 in bushing 32 as is the case with the radial bores 68, but open into the radial groove 69 in housing 18. The hollow screw 34 is in alignment with a sealing edge 83 on the bushing 32. The slot between the hollow screw 34 and the housing 18 is sealed by a packing ring 76. The end piece 33 has the same outer diameter as the bottom of the annular groove 39 on the end of bushing 32 facing end piece 33.

The aforedescribed parts are located in the right half of housing 18. The parts located in the left side of housing 18 correspond essentially to the aforedescribed parts and are indicated with the same reference numerals as the parts illustrated on the right side of the drawing, whereby the small letter "a" is added.

In its center, housing 18 has a connection port C to which line 17 is connected. A bore 77 is provided in the connecting location into which an exchangeable throttle screw 78 is screwed, defining the nozzle 16.

When the connecting location A3 is connected through directional control valve 1 with pump 5, the pressure medium flows into bore **66*a*, the hollow chamber 65*a*, the annular groove 48*a*, the oblique bore 67*a* and the chamber 46*a*. The main valve member 19*a* opens under the pressure of the pressure medium whereby pressure medium flows through the radial bores 68*a*, annular grooves 75*a* and 69*a*, hollow chamber 70*a* and the bore 71*a* to the connecting location B3 and from there through line 8*a* to hydromotor 2. The open position of the main valve member 19*a* is limited as soon as the limiting edge of annular groove 55*a* facing the valve seat 50*a* passes by the radial bore 74*a* in bushing 32*a* and thereby closes the chamber provided with the springs 49*a* and 64*a*. Simultaneously, pressure medium flows into chamber 44*a* from the annular groove 48*a* through radial bore 47*a*. A connection between the chambers 46*a* and 44*a* is also established through the hollow piston rod 23. The control piston 20*a* is under the pressure of the pressure medium fed from pump 5 on its piston rod side. In the illustrated position of control piston 20*a*, the chamber enclosing the control spring 35 is closed with respect to chamber 44*a* and is connected through control bore 38*a*, annular groove 39*a*, nozzle 16 and bore 77 through line 17 with supply container 6. The control piston 20*a* together with piston rod 30 is pushed to the right by means of the pressure prevailing in chambers 44*a*, 46*a* against the control spring 35, whereby the annular groove 37*a* comes into connection with chamber 44*a* and pressure medium flows through the calibrated nozzle 36*a* into the chamber provided with the control spring 35*a*. During the movement of the control piston 20*a* in the direction of end piece 33*a*, the control edge 40*a* of control piston 20*a* passes by the adjacent control bore 38*a*, whereby its orifice cross section is reduced. Thereby, a pressure builds up in the chamber having the control spring 35*a*, until the control piston 20*a* comes into a rest position due to the balance of the forces acting thereupon. The pressure in the chambers 44*a*, 46*a* acts on the left side of the control piston 20*a* connected with the piston rod 23*a*, and the pressure in the chamber which encloses the control spring 35*a* acts on the right side of the piston 20*a* and the force of the control spring 35*a* acts toward the right side of the drawing. Therefore, a pressure differential prevails between chamber 44*a* and the chamber with the control spring 35*a*, which corresponds to the force of control spring 35*a*. In the balanced position of the control piston 20 a constant quantity of liquid flows through the calibrated nozzle 36*a*, the control bore 38*a* and the nozzle 16 (throttle) to supply container 6, depending on the cross section of calibrated nozzle 36*a*** and on the pressure corresponding to the force of control spring 35*a*.

The pressure building up between the two interconnected annular grooves 39 and 39*a* is defined by the cross section of throttle 16. The pressure in the annular grooves 39*a*, 39 propagates through the control bore 38 into the chamber receiving the control spring 35 and acts in the same direction as this control spring against the control piston 20 mounted in the right half of housing 20. This pressure remains constant as long as the control piston 20*a* is in its balanced position. Due to the pressure on the side of the end piece 33 exerted on the control piston 20 and the force resulting therefrom, the valve seat 52 of pre-control member 51 is at first lifted from its seat in main valve member 19 and the valve part 53, which is designed as a slide, closes the connection from the port B2 to the chamber provided with the valve spring 49. The pressure generated by the load acting on hydromotor 2 in the chamber with the valve spring 49 drops through the center bore 57, the transverse bore 58, the chamber 59, the stepped valve bore 54 to the pressure in chamber 46 or 44. Now the main valve member 19 is pressure balanced and the control piston 20 engages with its piston rod 23 onto the main valve member 19 and lifts it from the frustoconical valve seat 50 of bushing 32. The main valve member 19 is now displaced from control piston 20 against the force of valve spring 49 to such an extent until the quantity of pressure medium flowing through the connecting port B2, bore 71, hollow chamber 70, the two annular grooves 69 and 75, radial bores 68, chamber 46, the oblique bore 67, the two annular grooves 48 and 80, hollow chamber 65, bore 66, the connecting port A2, has built up a defined pressure on the control edge of the proportional directional control valve 1. This pressure, which acts through the radial bore 47 in chamber 44 and onto the annular face of the control piston 20, as well as through the transverse bores 43 and the bores 82 which are disposed parallel to the pin 45 onto the face of piston rod 23, opposes the pressure prevailing in the chamber receiving the control spring together with the force of the valve spring 49, and the force of control spring 35.

A balance of forces prevails on control piston 20 when the forces of the control spring 35 and the pressure acting in the chamber provided with the control spring 35 are the same on the one side as the force exerted by the pressure in chamber 44 on control piston 20 and the piston rod 23, in addition to the force exerted by the valve spring 49, on the other side. Since the force exerted on control piston 20 from the left is constant, a constant pressure prevails in chamber 44 and thereby in connection port A2. When the load acting on the hydromotor 2 changes, the predetermined constant pressure in connection port A2 is automatically adjusted by the corresponding control movements of the main valve member 19.

The mode of operation of the two sides of the double valve 7, 7*a* is reversed when the other side of the hydromotor 2 is connected with the pressure side of pump 5 or with the supply container 6, respectively.

The constant control pressure required for the load independent braking movement is not obtained by an additional control device in the aforedescribed double valve, but by the control pistons 20*a* or 20 on the side of the double valve whose main valve member 19*a* or 19 controls the pressure medium supply to hydromotor 2. This feature results in a compact construction which has the additional advantage due to the fact that as shown in the illustrated embodiment of the double valve, the chambers receiving the two control springs 35, 35*a* are facing each other and are connected through the annular grooves 39, 39*a* with the common nozzle 16. Since the two control chambers with the two control springs 35 and 35*a* are under the same pressure, no special reverse switching member between these two control chambers is required. Therefore, the control piston 20, 20*a* has also the additional function of a flow regulator, whereby the two control valves 7 or 7*a* in the common housing 18, cooperate together.

Figure 3:
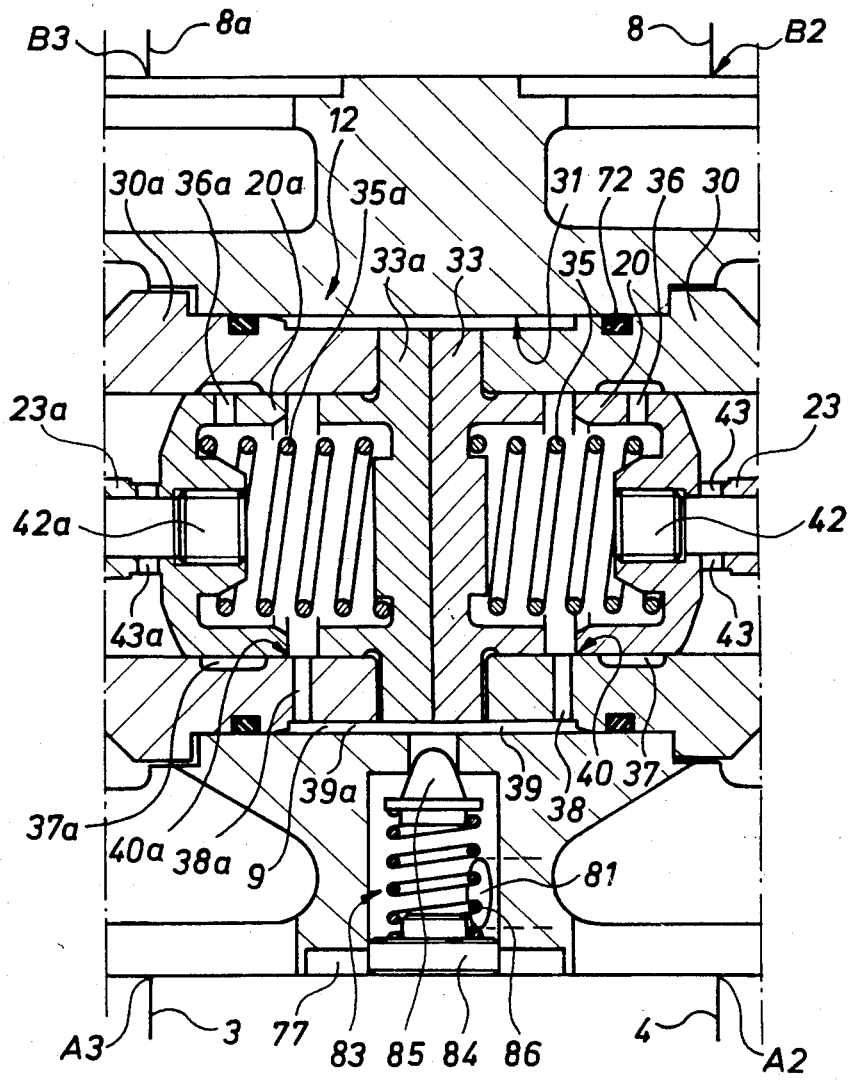
FIG. 3 is a segment of a modification of the double valve of FIG. 2.

In FIG. 3, instead of a nozzle 16 a pressure relief valve 83 is provided in bore 77 which opens in the direction to channel 81 leading to control line 17. From the outside, a retaining screw 84 is screwed into bore 77. The end of bore 77 facing away from the retaining screw 84 is provided with a practically non-throttling orifice which is connected with the annular groove 39. The side of the orifice facing away from the annular groove 39 is designed as a valve seat which coacts with a cone-shaped valve member 85. A valve spring 86 is braced between the retaining screw 84 and the valve member 85.

The term "throttling means" denotes both the nozzle 16, as well as the pressure limiting valve 83.

What is claimed as new and desired to be protected by Letters Patent is set forth in the appended claims:

1. Device for controlling a hydromotor, comprising a restricting control valve having connecting ports to a pressure source and to the hydromotor; a second control valve designed in the form of a releasable non-return valve; an actuating cylinder-and-piston unit associated with the second control valve and having a control piston dividing the cylinder of the unit into two control spaces, one of said control spaces housing a biasing spring for said piston and being provided with a first control port, the other control space being formed with a second control port, said second control valve including connecting ports leading, respectively to the hydromotor and to the restricting control valve, a flow regulator having an outlet connected to the first control port of the cylinder-and-piston unit, and an inlet connected to the connecting port of the restricting control valve which leads to the hydromotor, the outlet of said flow regulator and said first control port being connected via throttling means to a supply container, and the connecting port of the second control valve leading to the restricting control valve being further connected to the second control port of the cylinder-and-piston unit.

2. Device in accordance with claim 1, wherein said restrictive control valve is an electrohydraulic proportional directional control valve.

3. Device in accordance with claim 1, further including an additional second control valve designed in the form of a releasable non-return valve with an additional cylinder-and-piston unit and an additional flow regulator each symmetrically connected with respect to the first mentioned second control valve, cylinder-and-piston unit and the flow regulator, said restricting control valve having another connecting port leading to the hydromotor via the additional second control valve whereby one of the second control valves being open and the other closed during operation.

4. Device in accordance with claim 3, wherein the first ports of the control cylinders and the outlets of the flow regulators are connected with each other.

5. Device in accordance with claim 3, wherein the two second control valves are mounted in a common housing, whereby the two control pistons are disposed at opposite ends of the housing, each control piston being provided with a calibrated nozzle, with a control edge and with a piston rod which is coupled to a valve member of the assigned second control valve, the calibrated nozzle and the valve member being closed on the one side of the housing when the valve member and the calibrated nozzle are open on the other side of the housing and vice versa.

6. Device in accordance with claim 5, wherein the valve member of each second control valve has a chamber for receiving a control spring which is connected by means of at least one transverse bore in the valve member with an annular groove connected with the hydromotor, and this connection being interrupted in a predetermined position of the valve member.

7. Device in accordance with claim 5, wherein each valve member includes a control opening, a pre-control member cooperating with the control opening, and the control opening being connected with a transverse bore.

8. Device in accordance with claim 5, wherein each valve member and the control piston are mounted in a bushing inserted into the housing, each bushing having a control bore controlled by the control piston, the control bore opening into an annular groove disposed on the circumference of one bushing and which is connected with another annular groove formed on the other bushing, and the interconnected annular grooves being in connection with the supply container by means of the throttling means.

* * * * *